US006228222B1

(12) United States Patent
Meschenmoser et al.

(10) Patent No.: US 6,228,222 B1
(45) Date of Patent: May 8, 2001

(54) PRESS ARRANGEMENT AND METHOD THEREOF

(75) Inventors: Andreas Meschenmoser, Horgenzell; Karl Steiner, Herbrechtingen; Andreas Zierhut, Ravensburg, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/292,562

(22) Filed: Apr. 15, 1999

(30) Foreign Application Priority Data

Apr. 16, 1998 (DE) ..... 198 16 759

(51) Int. Cl.[7] ..... D21F 3/00

(52) U.S. Cl. ..... 162/360.3; 162/360.3; 162/198; 162/360.2; 162/358.1; 162/358.3; 162/253; 162/262; 162/DIG. 10; 162/205; 100/73; 100/74; 100/161

(58) Field of Search ..... 162/198, 360.3, 162/360.2, 358.1, 358.3, 253, 262, DIG. 10, 205; 100/73, 74, 161

(56) References Cited

FOREIGN PATENT DOCUMENTS

| | | |
|---|---|---|
| 8805966 | 10/1989 | (DE) . |
| 4321404 | 11/1993 | (DE) . |
| 29506352 | 7/1995 | (DE) . |
| 19652018 | 6/1998 | (DE) . |

*Primary Examiner*—Stanley S. Silverman
*Assistant Examiner*—Mark Halpern
(74) *Attorney, Agent, or Firm*—Greenblum & Bernstein P.L.C.

(57) ABSTRACT

A method for the treatment of a material web and a press arrangement with a plurality of press gaps. A roll has a flexible press jacket supported from an inside, and forms a respective press gap with each of at least two further driven rolls. The drive power, or speed of one of the driven rolls, is regulated in accordance with a predetermined desired value, to ensure a common speed of the driven roll. A maximum line force and/or drive power of a front press gap, considered in a web running direction, is controlled and/or regulated, at least within a certain range, in accordance with a maximum line force, or drive power, of a rear press gap, considered in the web running direction.

31 Claims, 2 Drawing Sheets

PRESS ARRANGEMENT AND METHOD THEREOF

CROSS-REFERENCE TO RELATED APPLICATIONS

Figure 1:
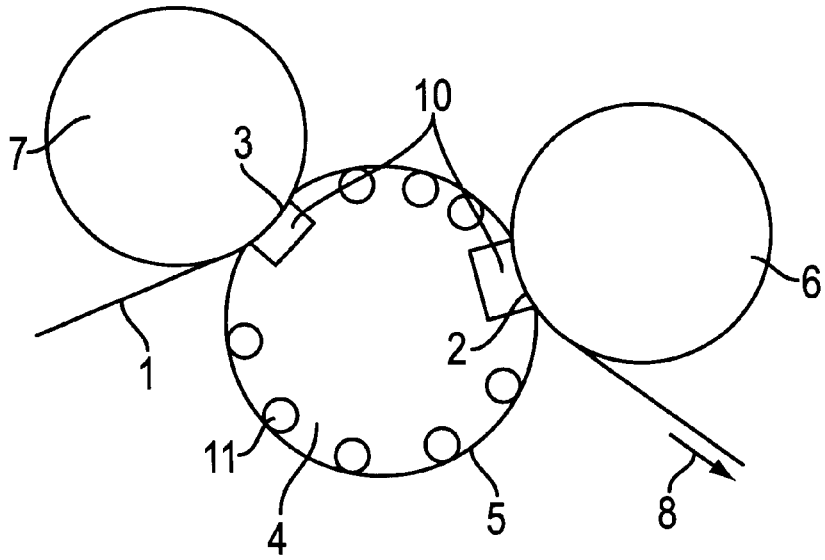

The present application claims priority under 35 U.S.C. § 119 of German Patent Application No. 198 16 759.8, filed on Apr. 16, 1998, the disclosure of which is expressly incorporated by reference herein in its entirety.

The invention relates to a press arrangement for the treatment of a material web in a plurality of press gaps, comprising a roll which has a flexible press jacket supported from the inside and which forms a respective press gap with each of at least two further driven rolls.

An arrangement of this kind is, for example, known from DE-OS 43 21 404 and serves there for the dewatering of a fiber material web. However, a compact arrangement of this kind causes problems, in particular with respect to the drive of the rolls. In this respect changing and unfavorable mechanical loadings of the flexible press jacket can arise in particular.

The flexible press jacket permits the formation of press gaps extended in the web running direction, for example through the support on concavely shaped support elements. On the other hand, the flexible press jacket, however, also requires the most accurate synchronization possible of the speed of the driven rolls, because otherwise a jacket deformation arises. A mechanical or electrical coupling of the drives is very complicated and expensive.

The invention is thus based on the object of providing a press arrangement of the initially named kind in which a common speed of the driven rolls is achieved in a manner which is as simple and accurate as possible. Moreover, a situation should be achieved in which a mechanical loading of the flexible press jacket is ensured which is as constant as possible and as considerate as possible over the full range of speed and line forces of the press arrangement.

In accordance with the invention this object is satisfied in that rolls the drive power or the speed at one of the driven is regulated in accordance with a predetermined desired value.

In this connection a regulation of the drive power or of the speed of the other driven roll can be dispensed with as a further simplification. In the end result, the same speed arises at the non-regulated roll as at the regulated roll through the coupling via the flexible press jacket.

Since the drive power must largely be expended for friction and compression, it is of advantage to regulate the drive powers of the two driven rolls and to keep the ratio constant in accordance with the circumstances and/or to adapt it to the ratio of the line forces of the two corresponding press gaps.

In this way account is in particular taken, in advantageous manner, of the fact that the line forces have a decisive influence on the drive power that is required.

A cylindrical press jacket which is of a shape which is as stable as possible is of advantage for a simple drive of the rolls.

However, as a result of the use of the flexible press jacket for the coupling between the press gaps, a deformation of the press jacket can still arise, even though to a small extent. In order to counteract this, the press gaps should have the smallest possible spacing from one another, and the regulated roll should be arranged in the web running direction after the unregulated roll. In the end result, speed differences merely lead to restricted deformation of the short section between the press gaps.

It is, however, also possible, to at least partly support the run of the flexible press jacket between the press gaps.

As an additional element for the coupling between the press gaps, a belt, for example in the form of a felt, screen or press belt, can also be guided through the two press gaps and should itself preferably be driven. In order to make the coupling efficient, the belt should be guided in such a way that it leaves the first press gap approximately tangentially with respect to the driven roll and runs into the second press gap approximately tangentially with respect to the driven roll.

The press arrangement is particularly suited for the dewatering and/or smoothing of paper, card or tissue webs.

The object underlying the invention is further satisfied in accordance with the invention in that the maximum line force and/or the drive power of a front press gap considered in the web running direction is controllable and/or regulatable, at least within a certain range, in dependence on the maximum line force or the drive power of a rear press gap when considered in the web running direction.

As a result of this design, a mechanical loading of the flexible press jacket, which is as constant as possible and also as considerate as possible is ensured over the full range of speeds and line forces of the press arrangement.

A preferred practical embodiment of the press arrangement of the invention is characterized in that the rear driven roll associated with the rear press gap can be operated at a higher drive power than the front driven roll associated with the front press gap, and in that the ratio of the drive powers of the two driven rolls is controllable and/or regulatable in dependence on the ratio of the maximum line forces of these two driven rolls. Since the rear driven roll is operated at a higher drive power than the front driven roll, it is ensured that the flexible press jacket is always pretensioned during the normal operation in the direction of the rear press gap.

It is also of advantage if the ratio between the maximum line force of the front press gap and the maximum line force of the rear press gap is kept constant, and the ratio between the drive power or the desired current value of the front driven roll and the drive power or the desired current value of the rear driven roll is proportional to and preferably the same as the constant ratio of the maximum line forces of the two press gaps. In this case the ratio between the maximum line force of the front press gap and the maximum line force of the rear press gap can in particular be kept at a constant value smaller than 1, and the ratio of the drive powers or of the desired current values of the driven rolls can be the same as this ratio of the maximum line forces which is kept constant. Since the ratio of the maximum line forces of the two press gaps is kept smaller than 1, it is simultaneously also ensured that the drive power of the front driven roll remains smaller than that of the rear driven roll and the flexible press jacket accordingly remains prestressed in the direction of the rear press gap.

In an expedient practical embodiment the roll having the flexible press jacket can be supported from the inside in the region of the front and rear press gaps, in each case by at least one pressure loadable support element, and the maximum line force of a respective press gap can be correspondingly set via the relevant pressure. In this case it is of advantage if the pressure of the support element provided in the region of the rear press gap is controllable and/or regulatable in dependence on a predeterminable desired value, and the pressure of the support element provided in the region of the front press gap is adjustable in dependence on the pressure of the rear support element. In this connection the rear support element can be connected via a central valve, preferably a central proportional pressure reducing valve, to a hydraulic pressure source, and the front support element can be adjustable in dependence on the pressure of the rear support element in a specific range via an additional valve, preferably an additional proportional sequential valve with ΔP function.

For the monitoring of the function of the additional valve, a further valve is expediently provided, preferably a proportional sequential valve with ΔPmax function, which opens on exceeding a difference pressure value, in particular a difference pressure value determined by area ratios, in order to take care, if necessary, of a pressure compensation between the rear and the front support element.

The driven rolls can basically also each be supported from the inside by at least one support element arranged in the region of the relevant press gap. In this case the oppositely disposed support elements of a respective driven roll and of the roll provided with the flexible press jacket can each be loadable by the same pressure in each case.

In a preferred practical embodiment, at least one of the driven rolls has a cylindrical press jacket of at least substantially stable shape.

In certain cases it can be of advantage if at least one preferably driven belt, in particular a felt, screen or press belt, is guided through the two press gaps.

The press arrangement of the invention can in particular be provided for the dewatering and/or smoothing of a fiber material web, such as in particular a paper, card or tissue web.

Figure 2:
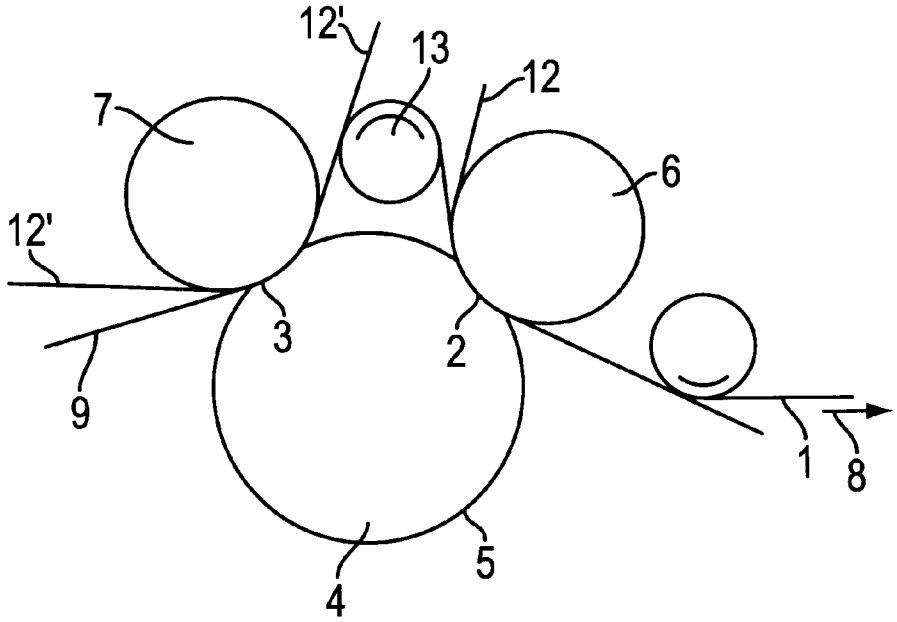
Figure 3:
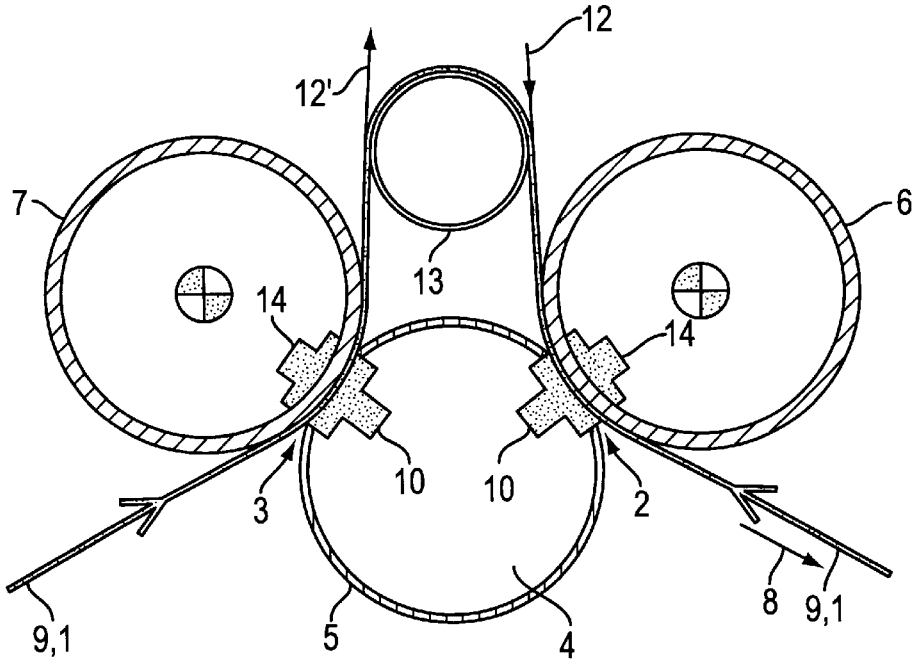
Figure 4:
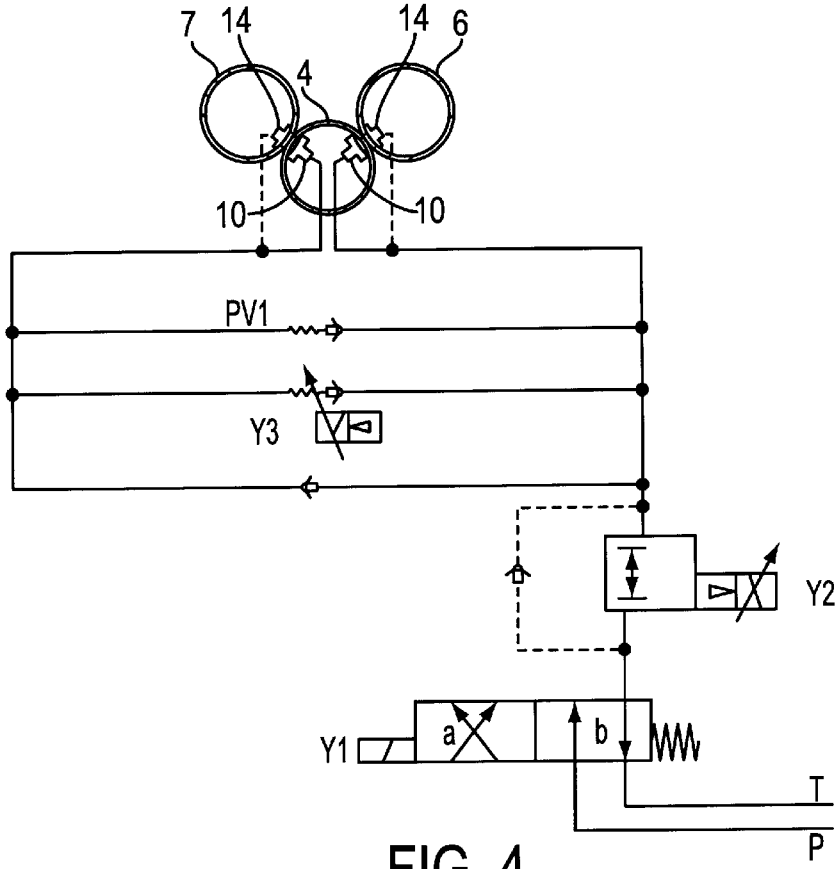

The invention will be explained in more detail in the following with reference to embodiments and to the drawings, in which are shown:

FIG. 1 a schematic illustration of an embodiment of a first press arrangement, FIG. 2 a schematic representation of a further embodiment of a press arrangement with a driven belt guided through the two press gaps, FIG. 3 a schematic illustration of a further embodiment of a press arrangement, and FIG. 4 a diagram of the principle of the hydraulic control of the press arrangement of FIG. 3.

In the two embodiments of FIGS. 1 and 2 the press arrangement consists in each case of a roll 4 having a flexible press jacket 5, which is supported from the inside, and which in each case forms a press gap 2, 3 with two further driven rolls 6 and 7. In this arrangement the drive power or the speed at one of the driven rolls, here for example the roll 6, is regulated in accordance with a predetermined desired value. As a result of the coupling via the press jacket 5 the same speed automatically arises at the driven roll 7.

The flexible press jacket 5 is supported in the region of each of the press gaps 2, 3 by a respective, preferably hydraulic support element 10 having a concavely shaped, hydrodynamically and/or hydrostatically lubricated pressing surface. In this way, long press gaps 2, 3 are formed.

In order to reduce the loading of the flexible roll jacket 5, the press rolls 6, 7 are arranged at a smallest possible spacing from one another. In this connection the regulated roll 6 is arranged after the roll 7 in the web running direction 8. Moreover, the flexible roll jacket 5 is supported between the press gaps 2, 3 partly via guide elements 11 in the form of rollers, strips or the like, so that deformations of the roll jacket 5 resulting from speed differences of the rolls 6, 7 are very strongly reduced.

The driven rolls 6, 7 have, for example, a cylindrical press jacket of stable shape, which can likewise be supported from the inside. However, these rolls 6, 7 can, for example, also be formed by solid rolls. In this connection a respective electrical drive is preferably coupled to the axles of the rolls 6, 7.

In the embodiment of FIG. 1 only the fiber material web 1 is led through the press gaps 2, 3, whereby a smoothing is achieved. In FIG. 2 a press arrangement is shown for the dewatering of the fiber material web 1. For this reason an endless belt 9 in the form of a press felt which wraps around the flexible press jacket is led through the two press gaps 2, 3. At the other side of the fiber material web 1, a separate endless press felt 12, 12' runs through each press gap 2, 3 respectively. The press felts 12, 12' serve to take up and lead away the water pressed out in the press gaps 2, 3. The belt 9 is guided between the press gaps 2, 3 over a guide roll 13 subjected to suction, so that the belt 9 leaves the first press gap 3 approximately tangentially relative to the driven roll 7 and runs into the second press gap 2 approximately tangentially relative to the driven roll 6. The guide roll 13 is likewise drivable, so that additional drive power can be introduced into the press gaps 2, 3.

In FIG. 3 a further embodiment of a press arrangement is shown in a schematic representation. A diagram of the principle of the hydraulic control of this press arrangement is reproduced in FIG. 4.

This press arrangement again also serves for the treatment of a material web 1, such as in particular a fiber material web, in a plurality of press gaps 2, 3. It also includes a roll 4, which has a flexible press jacket 5 supported from the inside by support elements 10, and which forms a respective press gap 2, 3 extended in the web running direction 8 with each of two further driven rolls 6, 7.

The driven rolls 6, 7 have a cylindrical press jacket of stable shape, which can be supported from the inside in the region of the respective press gap 2, 3 by at least one support element 14. In this connection an electrodrive is preferably coupled onto the axles of the rolls 6, 7. Separated, endless press felts 12 and 12' can again be guided through the two press gaps 2, 3. An endless belt 9 in the form of a press felt, which is again led through the two press gaps 2, 3 can also be provided and is, for example, guided between the two press gaps 2, 3, together with the material web, for example over a guide roll 13.

The front press gap 3, when considered in the web running direction 8, can be considered as an entry nip, and the rear press gap 2 considered in the web running direction 8 can be considered an outlet nip.

Accordingly, the front driven roll 7 can be considered an entry roll, and the rear driven roll 6 can be considered an outlet roll.

The rear press gap 2 is operated as a master, with the front press gap 3 being considered as its slave. The front press gap 3 considered as a slave is preferably operated in every mode of operation only in dependence on the master. This dependency is ensured, on the one hand, by the layout of the hydraulic control and regulating concept which results from FIG. 4, and, on the other hand, ensured by corresponding control and regulating software. The different operating modes of the press gaps 2, 3 are "close", "transfer", "load" and "open". The roll 4 having the flexible roll jacket 5 is not driven. The two driven rolls 6, 7, which can also be formed by solid rolls, can for example be part of a multi motor drive of a paper making machine. The maximum line force MLK of the press gaps 2, 3 is in the present case a function of the pressure in the support elements 10 and optionally 14.

In accordance with the hydraulic concept which results from FIG. 4, the hydraulic pressure oil supply for the total system is made available via a central, two-way switching valve Y1, with which the presses can be operated in the operating mode "close", "transfer", and "load" in the switch state "a" and can be operated in the operating mode "open" in the switch state "b".

The pressure in the system, from which the maximum line force MLK for the presses results, is set via a central proportional pressure reducing valve Y2.

The maximum line force MLK of the front press gap 3 can be varied via an additional proportional sequential valve Y3 with ΔP function in a specific range in dependence on the rear press gap 2.

The pressure in the front press gap 3 thus always lies beneath the pressure in the rear press gap 2, as a result of hydraulic losses, which can, for example, lie at about 2%.

The function of proportional sequential valve Y3 with the ΔP function is hydraulically monitored by a further sequential valve PV1 with ΔPmax function and operated hydraulically in such a way that on exceeding a value which is in particular determined by area ratios, in particular a pressure difference value, the sequential valve PV1 with ΔPmax function opens and serves for a pressure balance in the two systems. In the event of damage occurring in the hydraulic system, this always affects both press gaps 2, 3.

The operation of the two press gaps 2, 3 and also the electrical control results from the following:

The operation of the two press gaps 2, 3 takes place jointly, for example via four keys or comparable elements, in order to set the states "close", "transfer", "load" and "open".

The maximum line force in the rear press gap 2 is regulated in the operating states "transfer" and "load", by the pressure in the support sources or support elements 10 and optionally 14. For this purpose a desired value can be delivered to the control and regulating system, for example via a potentiometer or a comparable element. This system then compares the value with the actual value originating from a pressure sensor and transmits a corresponding desired value to the proportional, pressure reducing valve Y2.

The maximum line force in the front press gap 3 is also regulated in the operating states "transfer" and "load". This regulation, however, takes place in dependence on the rear press gap 2. The pressure is thus regulated in the manner described previously within a fixed range, which can, for example, amount to 50 to 95% of the maximum line force MLK of the rear press gap 2, with the proportional sequential valve Y3 with ΔP function serving here as the setting member.

An example for the control of the variable load distribution of the two drive motors results from the following:

With customary, force transmitting drive combinations, the drives are operated with a load distribution regulation, in which the load ratio is fixedly set. In this respect one of the (two) drives is the main drive and receives a tachometer for the detection of the speed of rotation. A regulator for the speed of rotation gives (two) parallel desired current values to the current regulators for the drives, which keep the load (torque) constant in the preset ratio.

In the present embodiments of the press arrangement of the invention it is now important that the flexible press jacket 5 between the press gap 3 forming the front entry nip and the rear press gap 2 forming the outlet nip always runs taut. This is achieved in that the drive of the rear driven roll 6 forming the outlet roll is operated at higher load than the drive of the front roll 7 forming the entry roll.

In order to ensure the force transmission for the flexible press jacket 5 as considerately and constantly as possible over the entire speed range and linear force range, the load ratio between the drives is tied as follows to the ratio between the maximum line force MLK of the entry nip 3 to the maximum line force MLK of the outlet nip 2 as follows:

$$\text{load ratio} = \frac{\text{desired current value drive entry roll}}{\text{desired current value drive outlet roll}} = \frac{MLK\ \text{entry nip}}{MLK\ \text{outlet nip}} = k$$

Through the hydraulic concept and the electrical control it is ensured that the load ratio is always smaller than 1.

The corresponding relationships also result from the following derivation:

The current take up of the drives is proportional to the output torque.

The total torque is composed from the sum of the torques.

$$M_{Ges}=M_E+M_A$$

with: $M_E$=torque of the entry roll $M_A$=torque of the outlet roll $M=Fr\cdot r$ $Fr=Fn\cdot\mu$ $Fn=A\cdot p$ with: Fr=frictional force Fn=normal force and $\mu$=frictional factor A=area of the shoe p=pressure on the shoe r=roll radius Thus, the following results for the torque of the entry roll:

$$M_E=\mu_E\cdot A_E\cdot r_E\cdot p_E$$

For the torque of the outlet roll the following results:

$$M_A=\mu_A\cdot A_A\cdot r_A\cdot p_A$$

For the total torque the following relationships applies:

$$M_{Ges}=\mu_E\cdot A_E\cdot r_E\cdot p_E+\mu_A\cdot A_A\cdot r_A\cdot p_A$$

For the same geometrical relationships the following applies:

$$\mu_E\approx\mu_A\approx\mu$$

$$A_E=A_A=A$$

$$r_E=r_A=r$$

where $\mu_E\leqq\mu_A$ and thus:

$$M_{Ges}=\mu\cdot A\cdot r(p_E+p_A)$$

For a rotating roll pack ($\mu \cdot A \cdot r$) is a constant, from which it follows that:

$$M_{Ges} \sim (p_E + p_A)$$

With the simplified relationship for three-phase motors:

$$I_{Ges} \sim M_{Ges}$$

with $I_{Ges}$=active components of the rotor currents of the motors from which results:

$$I_{Ges-(pE}+p_A)$$

With the condition that the maximum line force MLK and thus the pressure $p_E$ in the entry nip 3 is smaller by a factor "k" than the pressure $p_A$ in the outlet nip 2, the following applies:

$$I_{Ges} \sim p_A \cdot (k+1) \text{ with: } p_E = k \cdot p_A \ (0{,}5<k<1)$$

If now the factor "k" is also inserted at the current side, then the following results:

$$I_{Ges} = I_E \cdot k + I_A$$

REFERENCE NUMERAL LIST

1 material web
2 extended press gap
3 extended press gap
4 roll with a flexible press jacket
5 flexible press jacket
6 driven roll
7 driven roll
8 web running direction
9 support elements
10 guide elements
11 press felt
12' press felt
13 guide roll
14 support elements
Y1 2-way switching valve
Y2 proportional pressure reducing valve
Y3 proportional sequential valve with ΔP-function
PV1 sequential valve with ΔPmax-function

What is claimed is:

1. A press arrangement, having a plurality of press gaps, for treating a material web, comprising:

a roll with a flexible press jacket;

at least two driven rolls, a press gap of said plurality of press gaps being formed by each driven roll of said at least two driven rolls and said roll; and a controller that controls one of a drive power and driving speed of one driven roll of said at least two driven rolls in accordance with a predetermined desired value.

2. The press arrangement of claim 1, wherein said one of said drive power and said driving speed is not controlled by said controller at a remaining driven roll of said at least two driven rolls.

3. The press arrangement of claim 1, wherein said controller controls said drive power of each of said at least two driven rolls, a ratio of said drive power of each of said at least two driven rolls being controlled in accordance with a line force of a respective corresponding press gap.

4. The press arrangement of claim 1, wherein said at least two driven rolls have a cylindrical press jacket of a predetermined shape.

5. The press arrangement of claim 1, wherein said plurality of press gaps are arranged a predetermined distance from one another, a driven roll of said at least two driven rolls that is controlled by said controller being positioned, in a material web direction, after an unregulated driven roll of said at least two driven rolls.

6. The press arrangement of claim 1, wherein an inside portion of said flexible press jacket is supported between a press gap of said plurality of press gaps.

7. The press arrangement of claim 1, further comprising a drive belt that is guided through said plurality of press gaps.

8. The press arrangement of claim 7, wherein said drive belt comprises at least one of a felt belt, a screen belt, and a press belt.

9. The press arrangement of claim 7, wherein said drive belt is guided through said plurality of press gaps at an angle that is approximately tangential, relative to said at least two driven rolls.

10. The press arrangement of claim 1, wherein said press arrangement at least one of dewaters and smooths the material web.

11. A press arrangement, having a plurality of press gaps, for treating a material web, comprising:

a roll having a flexible press jacket;

at least two driven rolls, each driven roll of said at least two drive n rolls being arranged with respect to said flexible roll to form a respective press gap; and a regulator that regulates at least one of a maximum line force and a drive power of a front press gap of said plurality of press gaps, relative to a web running direction, in accordance with at least one of a maximum line force and a drive power of a rear press gap of said plurality of press gaps, relative to said web running direction.

12. The press arrangement of claim 11, wherein said at least two driven rolls comprise:

a front driven roll; and a rear driven roll, said rear driven roll being driven with a higher drive power than said front driven roll.

13. The press arrangement of claim 12, wherein said drive power of said rear driven roll and said drive power of said front driven roll is controlled in accordance with said maximum line forces of said rear press gap and said maximum line force of said front press gap.

14. The press arrangement of claim 11, further comprising a pressure loadable support element that supports said flexible roll from an inside of said flexible roll in a region of said plurality of press gaps, a maximum line force of a respective press gap being adjusted by an applied pressure of said support element.

15. The press arrangement of claim 14, wherein said pressure loadable support element comprises:

a rear support element positioned proximate said rear press gap; and a front support element positioned proximate said front press gap, said rear support element exerting a first pressure that is controlled in accordance with a predeterminable desired value, said front support element exerting a second pressure that is adjustable in accordance with said first pressure of said rear support element.

16. The press arrangement of claim 15, further comprising:

a hydraulic pressure source;

an additional valve; and a central valve connected to said rear support element and said hydraulic pressure source, said front support element being adjusted by said additional valve in a specific range in accordance with said first pressure of said rear support element.

17. The press arrangement of claim 16, wherein said hydraulic pressure source comprises a central valve.

18. The press arrangement of claim 17, wherein said central valve comprises a proportional pressure reducing valve.

19. The press arrangement of claim 16, wherein said additional valve comprises a proportional sequential valve with a pressure differential function.

20. The press arrangement of claim 15, further comprising a further valve that monitors said additional valve, said further valve opening when a specific difference pressure value is exceeded.

21. The press arrangement of claim 20, wherein said further valve comprises a proportional, sequential valve with maximum pressure differential function.

22. The press arrangement of claim 11, wherein said at least two driven rolls are each supported from an inside by a support element positioned proximate each of said plurality of press gaps.

23. The press arrangement of claim 11, wherein at least one driven roll of said at least two driven rolls has a cylindrical press jacket with a substantially stable shape.

24. The press arrangement of claim 11, further comprising a belt that is guided through said plurality of press gaps.

25. The press arrangement of claim 24, wherein said belt comprises at least one of a driven belt, a felt belt, a screen belt and a press belt.

26. A method for treating a material web with a press having a plurality of press gaps, comprising:

arranging at least two driven rolls in the press with respect to a flexible roll to form a respective press gap; and regulating at least one of a maximum line force and a drive power of a front press gap of the plurality of press gaps, relative to a web running direction, in accordance with at least one of a maximum line force and a drive power of a rear press gap of the plurality of press gaps, relative to the web running direction.

27. The method of claim 26, wherein the press arrangement at least one of dewaters and smooths the material web.

28. The method of claim 26, further comprising:

maintaining a ratio of a maximum line force of the front press gap and a maximum line force of the rear press gap constant, a ratio between one of a drive power and a desired current value of a front driven roll and a rear driven roll, relative to the web driving direction, being proportional related to the maximum line force of the front press gap and the maximum line force of the rear press gap.

29. The method of claim 28, further comprising maintaining the ratio at a constant value less than 1.

30. The method of claim 29, wherein said further valve comprises compensating for a pressure differential between the rear support element and the front support element.

31. The method of claim 29, comprising driving a rear driven roll of the at least two driven rolls with a higher drive power than a front driven roll of the at least two driven rolls.

* * * * *